United States Patent [19]

Premel et al.

[11] Patent Number: 4,538,676

[45] Date of Patent: Sep. 3, 1985

[54] GAS LIQUID PARALLEL FLOW DIRECT CURRENT HEAT EXCHANGER

[75] Inventors: Ulrich Premel; Jörgen Becker, both of Gummersbach, Fed. Rep. of Germany

[73] Assignee: L & C. Steinmüller GmbH, Gummersbach, Fed. Rep. of Germany

[21] Appl. No.: 468,942

[22] Filed: Feb. 23, 1983

[30] Foreign Application Priority Data

Feb. 24, 1982 [DE] Fed. Rep. of Germany ..... 3206512

[51] Int. Cl.[3] ..... F28D 7/12

[52] U.S. Cl. ..... 165/145; 165/160

[58] Field of Search ..... 165/145, 160; 122/7 R, 122/6 A

[56] References Cited

U.S. PATENT DOCUMENTS

| | | | |
|---|---|---|---|
| 1,819,785 | 8/1931 | Muhleisen | 165/145 |
| 2,693,346 | 11/1954 | Petersen | 165/160 |
| 3,871,444 | 3/1975 | Houser et al. | 165/160 X |
| 4,162,702 | 7/1979 | Andersson | 165/160 X |
| 4,395,618 | 7/1983 | Cunningham | 165/160 X |

FOREIGN PATENT DOCUMENTS

| | | | |
|---|---|---|---|
| 1013084 | 12/1965 | United Kingdom | 165/145 |
| 2039022 | 7/1980 | United Kingdom | 165/145 |

*Primary Examiner*—Sheldon J. Richter
*Assistant Examiner*—Randolph A. Smith
*Attorney, Agent, or Firm*—Becker & Becker, Inc.

[57] ABSTRACT

A gas/liquid, parallel flow heat exchanger in a waste-heat tank which is constructed as a pressure tank, is charged with coolant, and is connected after a pressure gasification. The waste-heat tank includes conduit-like elements of equal length which serve as heat transfer surfaces and are installed in conduit-like components or wall units. The wall units divide the interior of the waste-heat tank into regions having upwardly and downwardly directed fluid flow. A central, coaxial, polygonal, preferably hexagonal, cylindrical displacement body is provided, with the number of surfaces of the displacement body depending upon the number of heat transfer surface elements. Also provided are wall units which project out of the wall of the container of the waste-heat tank into the interior thereof across from the corners of the polygonal displacement body. Cylindrical displacement bodies are located centrally between the corners of the polygonal displacement body on an imaginary circle. The heat transfer surface elements, in turn, are coaxially arranged about these cylindrical displacement bodies.

4 Claims, 2 Drawing Figures

GAS LIQUID PARALLEL FLOW DIRECT CURRENT HEAT EXCHANGER

BACKGROUND OF THE INVENTION

The present invention relates to a gas/liquid, parallel flow heat exchanger which is disposed in a waste-heat tank that is constructed as a pressure tank, is charged with coolant, and is connected after a pressure gasification. The heat exchanger includes elements of equal length which serve as heat transfer surfaces and are installed into conduit-like or planar wall components are units. The wall units divide the interior of the waste-heat tank into regions having upwardly and downwardly directed fluid flow.

A gas/liquid heat exchanger in a waste-heat tank is known in which heat transfer surface elements of a heat exchange tube having constant radius and being helically guided are arranged along an imaginary circle at the same annular spacing, and where each heat transfer surface element is located in the annular and coaxial space between an outer tubular casing and an inner displacement body. In this connection, the annular space is provided for an upwardly directed fluid flow, and the free space between the wall of the container of the waste-heat tank and the outer tubular casings of the individual heat transfer surface elements are provided for a downwardly directed fluid flow.

However, due to a very expensive construction, such an arrangement of the heat transfer surface elements in the container of a waste-heat tank has drawbacks during manufacture and with regard to maintenance. Not only is a high accuracy required during manufacture, but in addition, the individual heat transfer surface elements can only be introduced into the container of the waste-heat tank as a total unit. However, it is then no longer possible to replace individual heat transfer surface elements easily when maintenance shows this to be necessary.

It is an object of the present invention to install or arrange heat transfer surface elements of a gas/liquid, parallel flow heat exchanger, in a waste-heat tank to attain the following characteristics. The elements are installed into conduit-like or wall components or units; the elements are arranged in the waste-heat tank which is constructed as a pressure tank, is charged with coolant, and is connected after a pressure gasification therewith. The arrangement structurally is such that as a whole the waste-heat tank is smaller; also, manufacture and maintenance thereof are simpler and more economical; furthermore, no reduction of the efficiency of the heat exchanger occurs by redividing the regions of the upwardly and downwardly directed fluid flow.

BRIEF DESCRIPTION OF THE DRAWING

This object, and other objects and advantages of the present invention, will appear more clearly from the following specification in connection with the accompanying drawings.

SUMMARY OF THE INVENTION

The heat exchanger of the present invention is characterized primarily by a container of a waste-heat tank including a cylindrical displacement body having a central, coaxial, polygonal configuration (preferably hexagonal, with the number of sides depending upon the number of heat transfer surface elements). There are wall units or components included therewith which project out of the wall of the container of the waste-heat tank into the interior thereof opposite the corners of the polygonal displacement body. The cylindrical displacement bodies are located centrally between the corners of the polygonal displacement body on an imaginary circle. The heat transfer surface elements in turn are arranged coaxially about these cylindrical displacement bodies.

According to further specific embodiments of the present invention, the heat transfer surface elements comprise one or more heat exchanger tubes. These tubes have a constant radius and are guided to extend in location surrounding the displacement body either in a helical configuration or in an arrangement according to a concentric and winding manner. Furthermore, the conduit-like inner space formed between the wall of the container of the waste-heat tank and the wall units is provided for the downwardly directed fluid flow; the space located around the heat transfer surface elements is provided for the upwardly directed fluid flow.

According to another embodiment of the present invention, the corners of the polygonal displacement body are connected with the aforementioned wall units by means of planar components or wall units.

DESCRIPTION OF A PREFERRED EMBODIMENT

Figure 1:
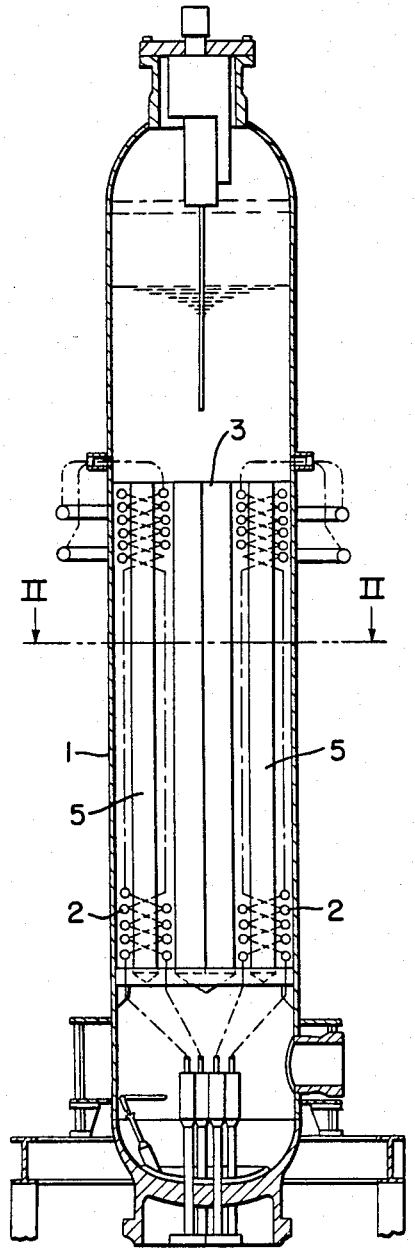
FIG. 1 is an elevational section view of heat transfer elements of a heat exchanger in a waste-heat tank in an arrangement having features according to the present invention.
Figure 2:
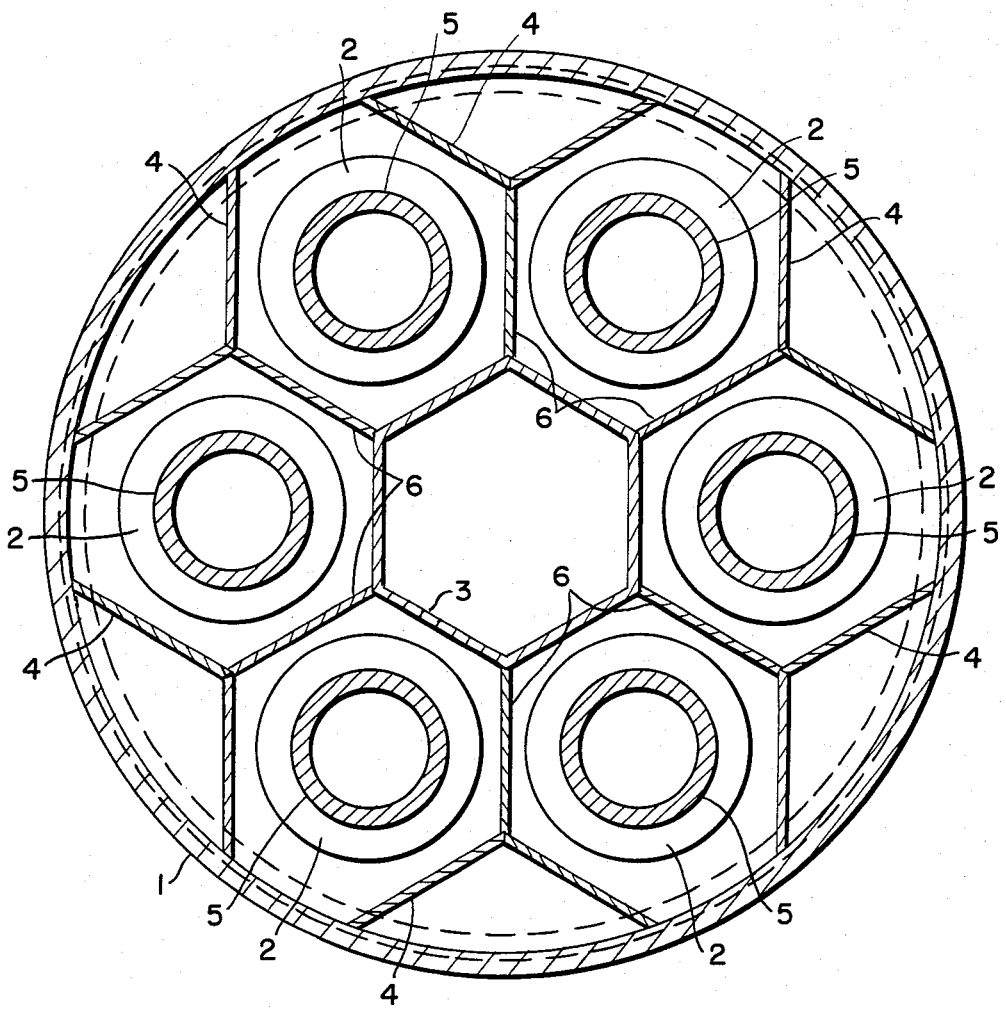
FIG. 2 shows in cross section taken along line II—II in one preferred inventive embodiment of a container of a waste-heat tank which is connected after a pressure gasification, is constructed as a pressure tank, and is charged with boiling water as a coolant.

Referring now to the drawings in detail, a central and coaxial, hexagonal, cylindrical displacement body 3 is located within the container wall of the waste-heat tank 1 in an arrangement shown by FIGS. 1 and 2. Opposite the corners of this displacement body 3, the wall units 4 project out of the container wall and into the inner space of the tank 1. The wall units 4 are respectively made out of two planar sheets which are disposed at an angle to one another. The wall units can also have a different cross sectional configuration; for example, tubular half shells can be used. The wall units 4 form a tubular or conduit-like space with respect to the container wall of the tank 1; this space is provided for downwardly directed fluid flow.

Centrally between the corners of the hexagonal, cylindrical displacement body 3, on an imaginary circle, there are located cylindrical displacement bodies 5 around which the heat transfer surface elements 2 are, coaxially arranged. The elements 2, which serve as heat transfer surfaces and are not shown in detail in the drawing, are made of one or more heat exchanger tubes; these tubes with constant radius are guided to extend in location around the displacement bodies either in a helical configuration or in an arrangement having a concentric and winding relationship therewith. In the free space between the displacement body 3 and the wall units 4, the boiling water flows upwardly due to density differences caused by temperature. The natural circulation resulting from the upwardly and downwardly directed fluid flow can be enhanced by the addition of cold feed water from an annular water collector via the parallel flow heat exchanger into the downwardly directed fluid flow, or, if appropriate, by the use of circulating devices.

If necessary, the corners of the hexagonal, cylindrical displacement body 3 can be connected with the wall units 4 by means of planar wall units 6. The length of the heat transfer surface elements 2, the conduit-like configuration of the wall units 4, the planar wall units 6, and the displacement bodies relative to each other is such that all have approximately the same length.

The advantage of a gas/liquid, parallel flow heat exchanger in a container of a waste-heat tank is in the realization of the following characteristics; the heat exchanger is provided with the inventive construction or design so that the heat transfer surface elements 2 can be individually introduced into the container together with the cylindrical displacement bodies 5. This considerably simplifies the construction of the container, and saves both time and cost during manufacture. By eliminating an outer heat transfer surface casing, the diameter of the container of the waste-heat tank can be reduced by about 10 to 15 percent, resulting in a savings both with regard to weight as well as with regard to purchase price.

Due to the possibility of removing the central displacement body 3 out of the container by itself, maintenance is not a problem. Not only can all of the heat transfer surface elements be inspected, but also individual heat transfer surface elements can at any time be quickly replaced by means of an enlarged opening provided at the top of the container of the waste-heat tank for repair purposes.

The present invention is, of course, in no way restricted to the specific disclosure of the specification and drawing, but also encompasses any modifications within the scope of the appended claims.

What we claim is:

1. A gas/liquid, parallel flow direct current heat exchanger in a waste-heat tank which is constructed as a pressure tank having a longitudinal axis, is charged with coolant, and is connected after a pressure gasification, said waste-heat tank being provided with an inner container wall; said heat exchanger with which a natural circulation exists rather than requiring any positive circulation comprising in combination therewith:

a central, polygonal first sealed displacement body without any medium flow therethrough which is coaxially disposed in said waste-heat tank and which has sides parallel to said axis, said sides intersecting to form corners of sides thereof;

first wall units connected to said inner container wall of said waste-heat tank and projecting angularly therefrom into the interior of said waste-heat tank; said first wall units being located substantially across said tank, projecting from the corners of the sides of said polygonal first displacement body; said first wall units serving to divide the interior of said waste-heat tank into regions, alternate ones of which provide means for upwardly and downwardly directed fluid flow;

cylindrical second displacement bodies having axes and disposed within said region centrally circumferentially between next adjacent corners of the sides of said polygonal first displacement body at predetermined locations radially outwardly thereof and spaced with axes thereof parallel to the longitudinal axis equidistantly therefrom and intermediate said polygonal first displacement body and said inner container wall; and elements equal in length relative to each other which serve as heat transfer surfaces and are respectively arranged coaxially about each of said second displacement bodies; with the number of sides of said polygonal first displacement body equal to the number of said heat transfer surface elements, said first wall units forming substantially triangular conduit-like spaces with said inner container wall of said waste-heat tank, said conduit-like spaces being provided as said regions for downwardly directed fluid flow; and which includes means defining a space about said heat transfer surface elements, which space is provided as said region for upwardly directed fluid flow alternately and laterally between said substantially triangular conduit-like spaces that serve as said regions for downwardly directed fluid flow.

2. A heat exchanger in combination according to claim 1, which includes six heat transfer surface elements, and a hexagonal first displacement body.

3. A heat exchanger in combination according to claim 1, in which said heat transfer surface elements respectively comprise at least one heat exchanger tube which is guided about its associated second displacement body with a constant radius helically as well as in a concentric and winding manner.

4. A heat exchanger in combination according to claim 1, which includes second planar wall units which connect the respective corners of the sides of said polygonal first displacement body with said first wall units.

* * * * *